US010204574B2

(12) United States Patent
Xian et al.

(10) Patent No.: US 10,204,574 B2
(45) Date of Patent: Feb. 12, 2019

(54) DISPLAY DEVICE AND ARRAY SUBSTRATE

(71) Applicant: BOE TECHNOLOGY GROUP CO., LTD., Beijing (CN)

(72) Inventors: Jianbo Xian, Beijing (CN); Hongfei Cheng, Beijing (CN); Yong Qiao, Beijing (CN); Yongchun Lu, Beijing (CN); Yongda Ma, Beijing (CN); Jian Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 62 days.

(21) Appl. No.: 14/891,082

(22) PCT Filed: May 14, 2015

(86) PCT No.: PCT/CN2015/078922

§ 371 (c)(1),
(2) Date: Nov. 13, 2015

(87) PCT Pub. No.: WO2016/107046

PCT Pub. Date: Jul. 7, 2016

(65) Prior Publication Data

US 2016/0196788 A1 Jul. 7, 2016

(30) Foreign Application Priority Data

Jan. 4, 2015 (CN) ..... 2015 2 0003243 U

(51) Int. Cl.
*G09G 3/36* (2006.01)
*H01R 12/73* (2011.01)

(52) U.S. Cl.
CPC ..... *G09G 3/3611* (2013.01); *H01R 12/732* (2013.01); *G09G 2300/0426* (2013.01); *G09G 2320/0209* (2013.01)

(58) Field of Classification Search
CPC ..... G09G 3/3648; G09G 2300/0426; G09G 3/3614; G09G 3/003
See application file for complete search history.

(56) References Cited

U.S. PATENT DOCUMENTS

2007/0058124 A1 3/2007 Chen
2008/0094328 A1* 4/2008 Ishiyama ..... G09G 3/3666 345/87

(Continued)

FOREIGN PATENT DOCUMENTS

CN 101075028 A 11/2007
CN 201035075 Y 3/2008

(Continued)

OTHER PUBLICATIONS

International Search Report of PCT/CN2015/078922 in Chinese, dated Sep. 22, 2015 with English translation.

(Continued)

*Primary Examiner* — Olga V Merkoulova
(74) *Attorney, Agent, or Firm* — Collard & Roe, P.C.

(57) ABSTRACT

A display device and an array substrate are disclosed. The display device includes a display panel and signal boards which supply signals to the display panel. At least a pair of signal boards that are connected with each other is electrically connected using a plug-in connection mode. A first plug-in structure is provided on a first signal board of each pair of signal boards connected in the plug-in connection mode, and a second plug-in structure corresponding to the first plug-in structure is provided on a second signal board of the pair of signal boards connected in the plug-in connection mode. Because at least a pair of signal boards that are connected with each other is electrically connected using a plug-in connection mode, a quantity of signal lines (Continued)

arranged between signal boards is reduced, which enables assembly and disassembly be more convenient.

17 Claims, 7 Drawing Sheets

(56) References Cited

U.S. PATENT DOCUMENTS

2008/0278428 A1* 11/2008 Song ..... G09G 3/3696 345/98
2011/0063261 A1* 3/2011 Park ..... G02F 1/13452 345/204

FOREIGN PATENT DOCUMENTS

CN 101916535 A 12/2010
CN 204302615 U 4/2015

OTHER PUBLICATIONS

Notice of Transmittal of the International Search Report of PCT/CN2015/078922 in Chinese, dated Sep. 22, 2015.
Written Opinion of the International Searching Authority of PCT/CN2015/078922 in Chinese, dated Sep. 22, 2015 with English translation.

* cited by examiner

DISPLAY DEVICE AND ARRAY SUBSTRATE

CROSS REFERENCE TO RELATED APPLICATIONS

This application is the National Stage of PCT/CN2015/078922 filed on May 14, 2015, which claims priority under 35 U.S.C. § 119 of Chinese Application No. 201520003243.0 filed on Jan. 4, 2015, the disclosure of which is incorporated by reference.

TECHNICAL FIELD

At least one embodiment of the present invention relates to a display device and an array substrate.

BACKGROUND

Liquid crystal display (LCD) devices are characterized by low power consumption, low radiation and low manufacturing cost, etc., and have been widely used in various types of electronic devices such as display devices, television (TV) sets, cell phones, digital cameras, and other digital electronic devices. Liquid crystal display devices primarily include display panels and signal boards which supply signals to the display panels. The signal boards, for example, may include system boards and TCON (timing controller) boards.

SUMMARY

A display device and an array substrate are provided in embodiments of the present invention, which can solve the following problem: because of a relative large quantity of lines of signal transmission elements arranged between signal boards, signal quality can be mutually influenced and assembly and disassembly can be difficult due to crossover of lines on a flexible printing circuit (FPC).

A display device is provided in at least one of the embodiments of the present invention, and the display device comprises a display panel and signal boards which supply signals to the display panel. At least a pair of signal boards that are connected with each other is electrically connected using a plug-in connection mode. A first plug-in structure is provided on a first signal board of each pair of signal boards connected in the plug-in connection mode, and a second plug-in structure corresponding to the first plug-in structure is provided on a second signal board of the pair of signal boards connected in the plug-in connection mode.

An array substrate is provided in at least one of the embodiments of the present invention, and the array substrate comprises a plurality of signal boards. In the plurality of signal boards, at least a pair of signal boards that are connected with each other is electrically connected using a plug-in connection mode. A first plug-in structure is provided on a first signal board of each pair of signal boards connected in the plug-in connection mode, and a second plug-in structure corresponding to the first plug-in structure is provided on a second signal board of the pair of the signal boards connected in the plug-in connection mode.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and, it is not limitative to the scope of the present invention.

DETAILED DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Figure 1:
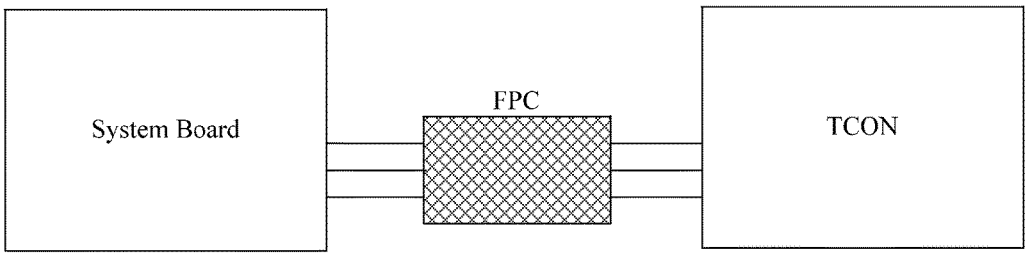
FIG. 1 is a schematic view of a connection mode between signal boards in a display device.

During research, the inventor(s) of the present application has noted that currently a system board is connected with a TCON (timing controller) board via a FPC (flexible printed circuit board) or one or more wires in a display device. As illustrated in FIG. 1, due to a relatively large quantity of wires (e.g., signal lines) connected between signal transmission elements arranged between signal boards, a crossover of wires on the FPC may occur, and thus the signal quality of wires can be mutually influenced. In addition, if the connection mode as illustrated in FIG. 1 is employed, assembly and disassembly will become relatively difficult.

In an embodiment of the present invention, a plug-in connection mode is employed in at least a pair of signal boards that are mutually connected in a display device. Thus, a quantity of signal lines arranged between signal boards is reduced and assembly and disassembly can be more convenient.

Embodiments of the utility model will be described in further details below in accompany with the drawings. It should be understood that, the described embodiments are only used to describe and illustrate the utility model and are not used to limit the utility model.

Figure 2A:
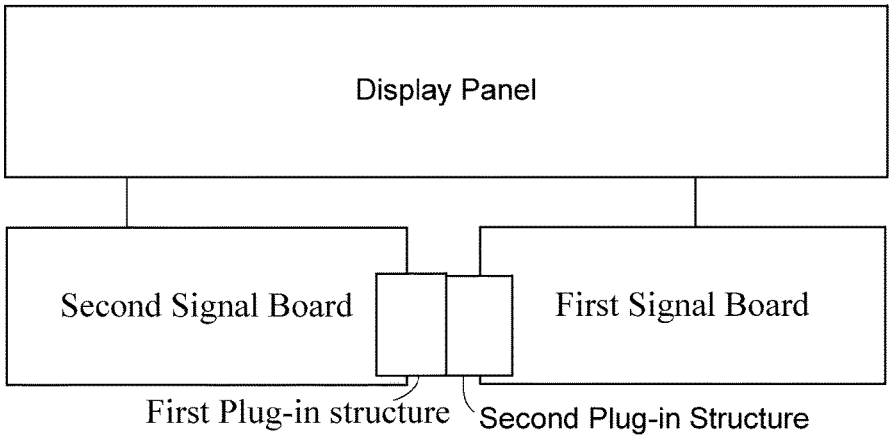
FIG. 2*a* is a structure block diagram of a display device in an embodiment of the present invention.

A display device is provided in an embodiment of the present invention. As illustrated in FIG. 2*a*, the display device comprises a display panel and signal boards, which supply signals to the display panel, where: a plug-in connection mode is employed in at least a pair of signal boards that are connected with each other; a first plug-in structure is provided on a first signal board of each pair of signal boards connected in the plug-in connection mode, and a second plug-in structure corresponding to the first plug-in structure is provided on a second signal board of the pair of signal boards connected in the plug-in connection mode.

In a display device provided in an embodiment of the present invention, a plug-in connection mode is employed in at least a pair of signal boards that are connected with each other, so as to reduce the quantity of signal lines arranged between signal boards and make assembly and disassembly more convenient.

It is to be explained that phrases including "the first signal board" and "the second signal board" are used to differentiate different signal boards in each pair of signal boards connected in a plug-in connection mode. The first signal board may represent any one signal board in each pair of signal boards connected in the plug-in connection mode and the second signal board may represent the other signal board in each pair of signal boards connected in the plug-in connection mode.

FIG. 2*a* illustrates at least one of the embodiments of the present invention by way of examples. Generally, respective signal boards can be disposed on a display panel, for example, on an array substrate of the display panel.

For example, preferable connection modes for a first plug-in structure and a second plug-in structure can include modes 1-4 as below, which will be described in detail hereinafter.

Figure 2B:
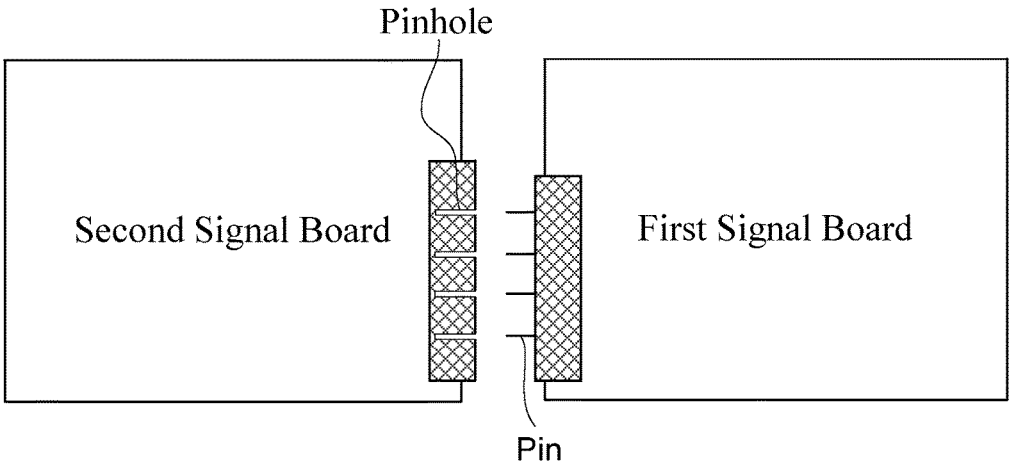
FIG. 2*b* is a schematic view of a first plug-in structure in an embodiment of the present invention.

A first mode: the first plug-in structure includes at least one pin and the second plug-in structure includes at least one plughole that corresponds to the at least one pin, as illustrated in FIG. 2*b*.

In the first mode, the first plug-in structure can include one pin or a plurality of pins, and each pin corresponds to a plughole on the second plug-in structure, so as to achieve electrical connection of signal transmission elements on the first signal board and/or the second signal board.

In the first mode, quantities, sizes and shapes of pins on a first signal board and quantities, sizes and shapes of plugholes on a second signal board can be designed based on signal transmission elements between the first signal board and the second signal board, and each pin corresponds to a plughole.

In the first mode, electrical connection of a first signal board and a second signal board can be achieved by inserting pins on the first signal board into plugholes on the second signal board, which makes assembly and disassembly convenient and reduces the quantity of signal lines arranged between the first signal board and the second signal board.

Figure 3:
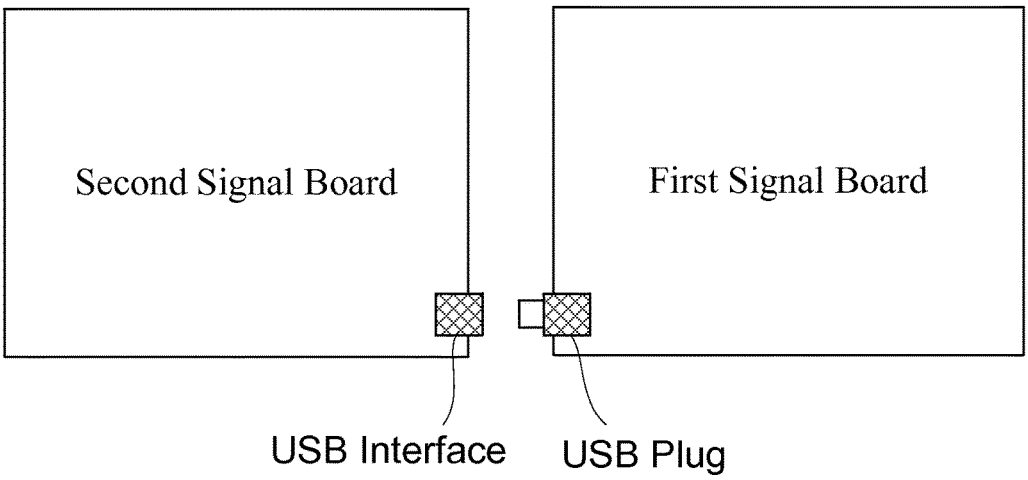
FIG. 3 is a schematic view of a second plug-in structure in an embodiment of the present invention.

A second mode: the first plug-in structure includes a USB (universal serial bus) plug and the second plug-in structure includes a USB interface that corresponds to the USB plug, as illustrated in FIG. 3.

In this mode, the first plug-in structure can include one USB plug or a plurality of USB plugs, and each USB plug corresponds to a USB interface on the second plug-in structure, so as to achieve electrical connection between signal transmission elements on the first signal board and the second signal board.

In this mode, quantities, sizes and shapes of USB plugs on a first signal board and quantities, sizes and shapes of USB interfaces on a second signal board can be designed according to signal transmission elements provided between the first signal board and the second signal board and in addition, each USB plug corresponds to a USB interface.

In this mode, it only needs to insert the USB plugs on the first signal board into the USB interfaces on the second signal board to achieve electrical connection between the first signal board and the second signal board, which makes assembly and disassembly convenient and reduces the quantity of signal lines arranged between the first signal board and the second signal board. Due to implementation of a USB data interface mode, electrical connection between a plurality of signal transmission elements between a first signal board and a second signal board can be achieved via connection of a USB plug and a USB interface with a high connection reliability.

Figure 4:
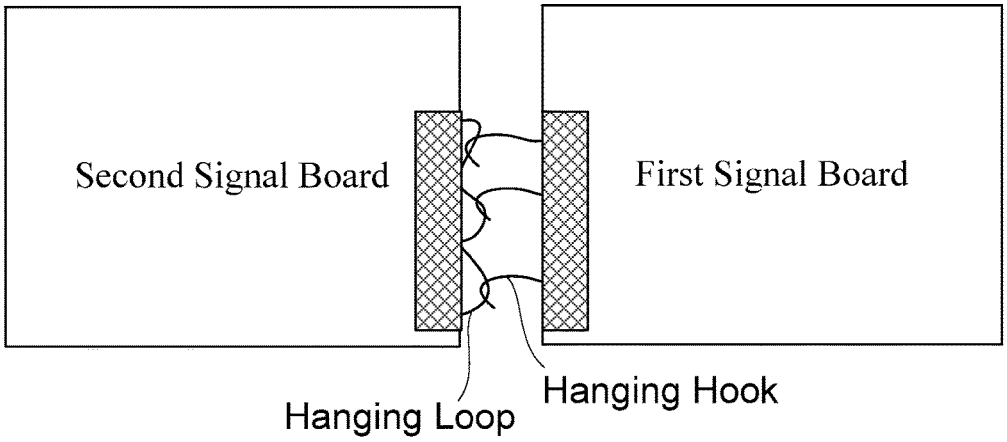
FIG. 4 is a schematic view of a third plug-in structure in an embodiment of the present invention.

A third mode: the first plug-in structure includes at least one hanging hook and the second plug-in structure includes at least one hanging loop that corresponds to the at least one hanging hook, as illustrated in FIG. 4.

In this mode, the first plug-in structure can include one hanging hook or a plurality of hanging hooks and each hanging hook corresponds to a hanging loop of the second plug-in structure, so as to achieve electrical connection of signal transmission elements on the first signal board and/or the second signal board.

In this mode, quantities, sizes and shapes of hanging hooks on a first signal board and quantities, sizes and shapes of hanging loops on a second signal board can be designed according to signal transmission elements provided between the first signal board and the second signal board, and in addition, each hanging hook corresponds to a hanging loop.

In this mode, it only needs to insert hanging hooks on the first signal board into hanging loops on the second signal board, whereby the hanging hooks contact with the hanging loops to achieve electrical connection between the first signal board and the second signal board, which makes assembly and disassembly convenient and reduces the quantity of signal lines arranged between the first signal board and the second signal board.

Figure 5A:
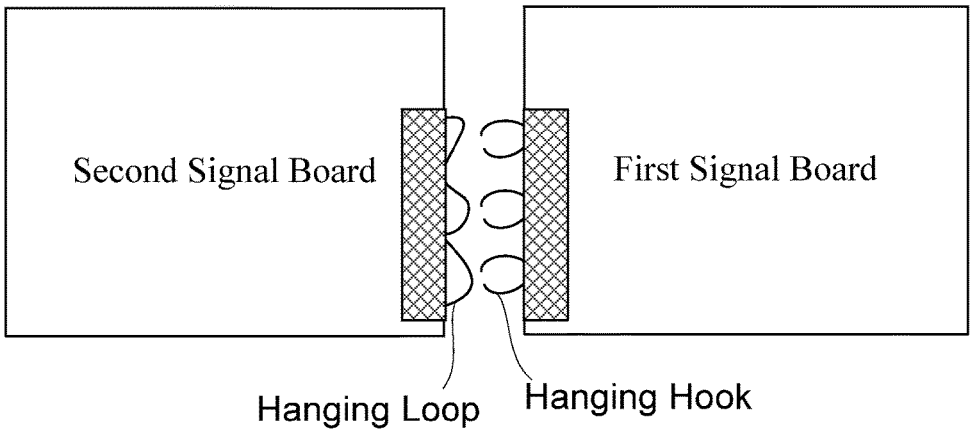
FIG. 5A is a schematic view of a structure of at least a hanging hook in an open state in an embodiment of the present invention.
Figure 5B:
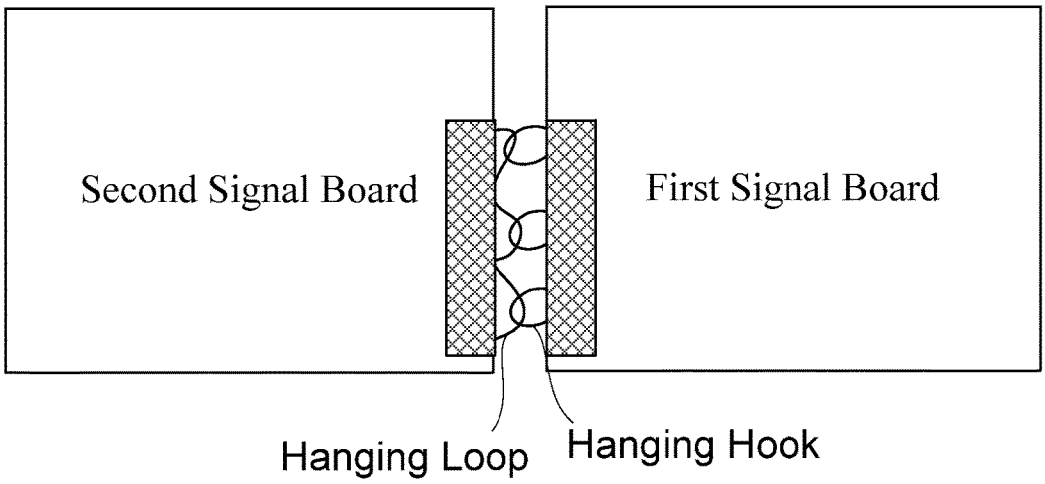
FIG. 5B is a schematic view of structure of at least a hanging hook in a closed state in an embodiment of the present invention.

In this mode, in order to enhance connection reliability of the hanging hooks on the first signal board and the hanging loops on the second signal board, the hanging hooks can be designed as a closable structure. That is, before a hanging hook is inserted into a hanging loop, the hanging hook is opened and in an open state (as illustrated in FIG. 5A); after the hanging hook is inserted into the hanging loop, the hanging hook is closed and in a closed state (as illustrated in FIG. 5B), to prevent the hanging hook from dropping off from the hanging loop.

Figure 6:
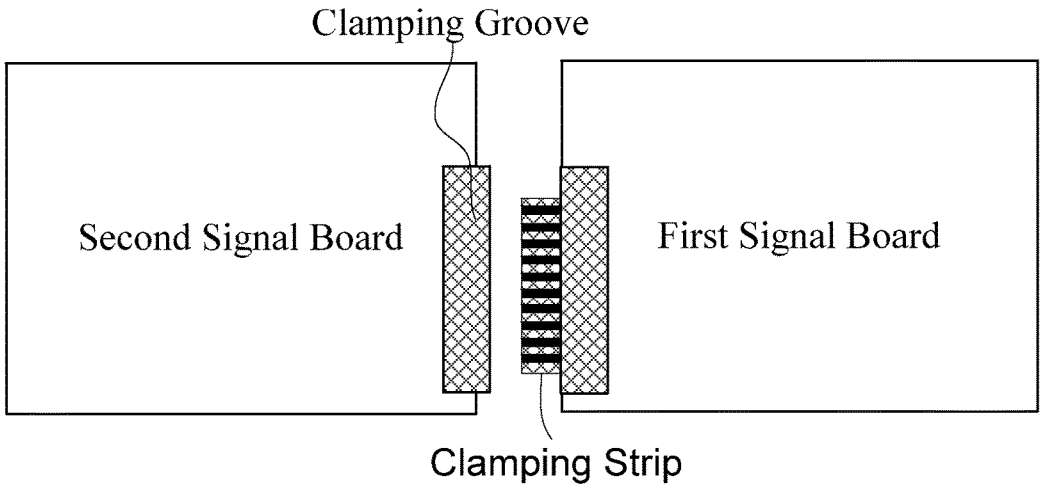
FIG. 6 is a schematic view of a fourth plug-in structure in an embodiment of the present invention.

A fourth mode: the first plug-in structure includes a clamping strip and the second plug-in structure includes a clamping groove that corresponds to the clamping strip as illustrated in FIG. 6.

In this mode, a size and a shape of the clamping strip (for example, a golden finger structure) on the first signal board and a size and a shape of the clamping groove on the second signal board can be designed according to signal transmission elements provided between the first signal board and the second signal board.

In this mode, it only needs to insert the clamping strip on the first signal board into the clamping groove on the second signal board to achieve electrical connection between the first signal board and the second signal board, which makes assembly and disassembly convenient and reduces the quantity of signal lines arranged between the first signal board and the second signal board.

Positions of the first plug-in structure and the second plug-in structure will be explained hereinafter. For example, positions of the first plug-in structure and the second plug-in structure can be implemented with approaches including the two preferable approaches in the following.

Approach 1: the first plug-in structure is disposed on a lateral side of the first signal board, and the second plug-in structure is disposed on a lateral side of the second signal board that faces the first plug-in structure and is disposed at a same horizontal plane as a surface where the first plug-in structure locates.

In this approach, because the first plug-in structure and the second plug-in structure are on a same horizontal plane, after the first plug-in structure is plugged into the second plug-in structure, the first signal board and the second signal board are also provided on a same horizontal plane.

Approach 2: the first plug-in structure and the second plug-in structure are respectively disposed on a surface of the first signal board and a surface of the second signal board that overlap with each other.

Figure 10:
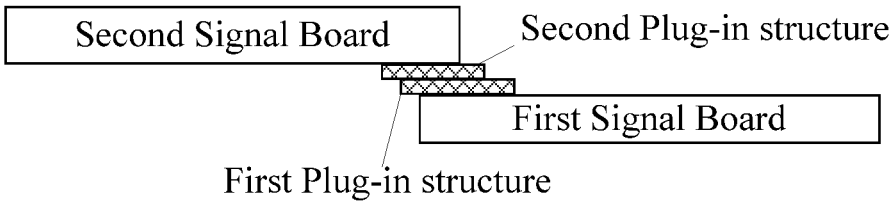
FIG. 10 is a schematic view of connection mode between signal boards in a display device.

For example, the first plug-in structure is disposed on an upper surface of the first signal board and the second plug-in structure is disposed on a lower surface of the second signal board. After the first plug-in structure and the second plug-in structure are plugged together with each other, the first signal board and the second signal board are partially overlapped with each other, as shown in FIG. 10.

In this approach, because the first plug-in structure and the second plug-in structure are respectively disposed on a surface of the first signal board and a surface of the second signal board that overlap with each other, a space for distribution of the first signal board and the second signal board can be reduced; and because the first signal board and the second signal board are not required to be on a same horizontal plane, a requirement for a flatness of a back panel is alleviated.

Based on any embodiment mentioned above, for example, a plug-in connection mode can be employed in each pair of mutually connected signal boards in the display device.

Based on any embodiment mentioned above, for example, the first signal board can be a TCON (timing controller) board and the second signal board can be a system board for supplying a driving signal; or, the first signal board can be a system board for supplying a driving signal and the second signal board can be a power supply board for supplying a working voltage; or, the first signal board can be a TCON board and the second signal board can be a power supply board for supplying a working voltage.

Based on any embodiment mentioned above, for example, the display device comprises at least two system boards for supplying driving signals, with the first signal board being one system board of the two system boards and the second signal board being the other system board of the two system boards.

Three embodiments will be provided below to explain connection modes of signal boards in the display device provided in the embodiments of the present invention. It should be pointed out that the following embodiments are just used to explain connection modes of signal boards and are not used to limit the signal boards or connection modes of the signal boards. Two mutually connected signal boards are not limitative to the connection modes described in the embodiments and other connection modes can also be employed.

A first embodiment: in the embodiment, the signal boards comprise a system board, a TCON board and a power supply board. The system board is connected with the TCON board and the system board is connected with the power supply board.

Figure 7:
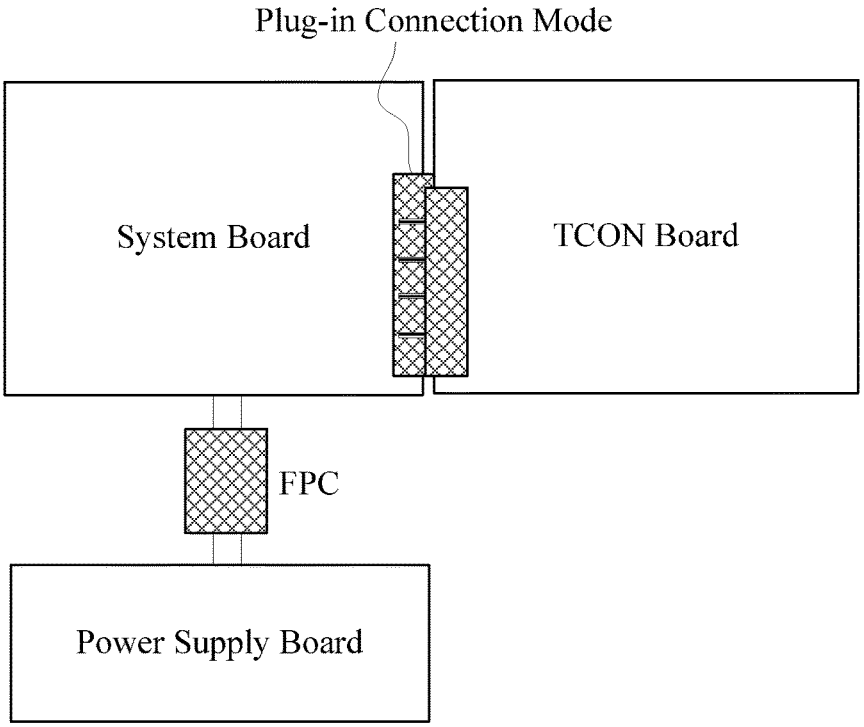
FIG. 7 is a schematic view of a first embodiment of the present invention.

In the embodiment, a plug-in connection mode is employed in part of the signal boards that are mutually connected. For example, the system board and the TCON board are connected by a plug-in connection mode while the system board and the power supply board are still connected by a FPC as illustrated in FIG. 7.

A second embodiment: in the embodiment, the signal boards comprise a system board, a TCON board and a power supply board. The system board is connected with the TCON board and the system board is connected with the power supply board.

Figure 8:
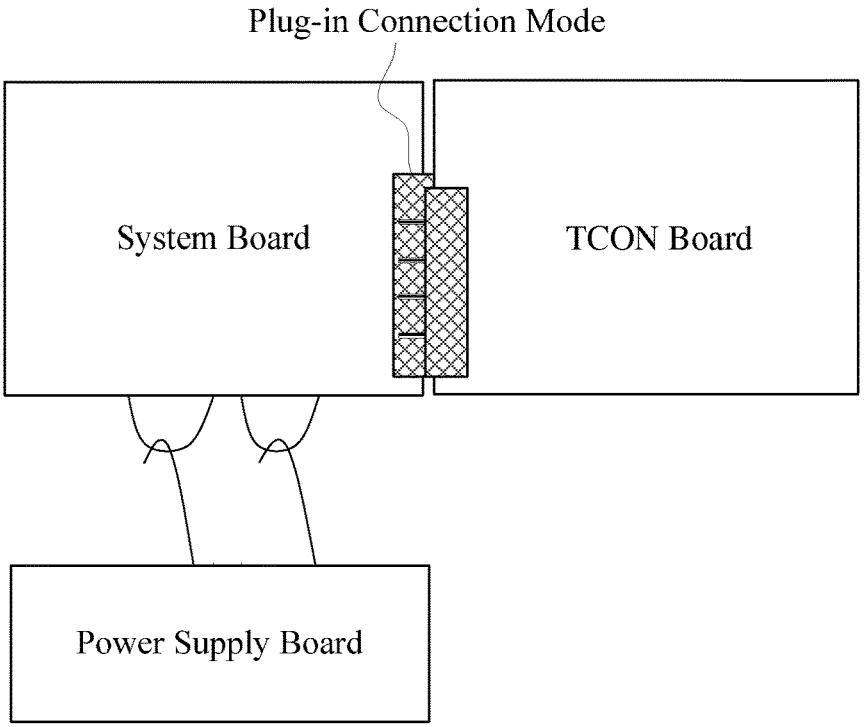
FIG. 8 is a schematic view of a second embodiment of the present invention.

In this embodiment, a plug-in connection mode is employed in each pair of the signal boards that are mutually connected; that is, the system board and the TCON board are connected in a plug-in connection mode and the system board and the power supply board are also connected in a plug-in connection mode as illustrated in FIG. 8.

A third embodiment: in the embodiment, the signal boards comprise two system boards (i.e., a first system board and a second system board) and a TCON board. The first system board is connected with the second system board, and the second system board is connected with the TCON board.

Figure 9:
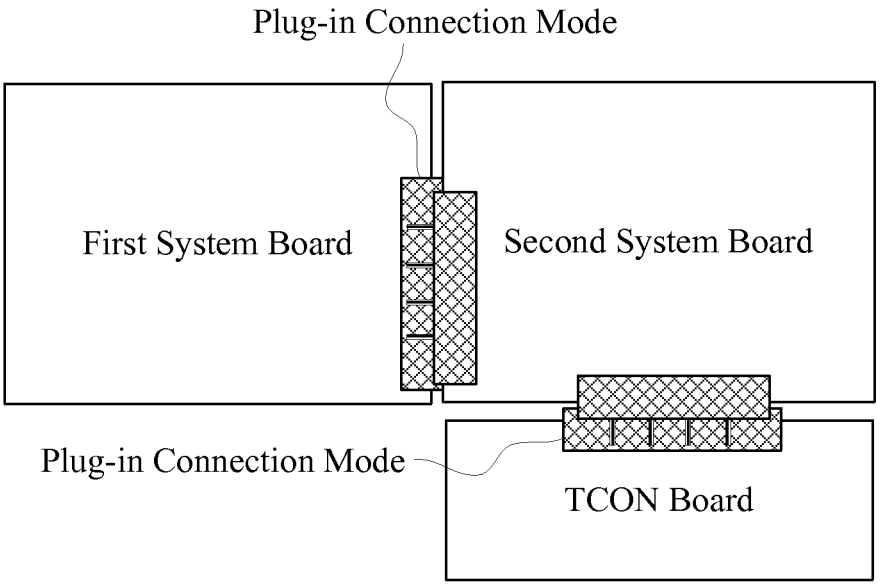
FIG. 9 is a schematic view of a third embodiment of the present invention.

In the embodiment, a plug-in connection mode is employed in each pair of the signal boards that are mutually connected; that is, a plug-in connection mode is employed for connection between the first system board and the second system board and a plug-in connection mode is also employed for connection between the second system board and the TCON board as illustrated in FIG. 9.

Based on any embodiment mentioned above, a display device provided in the embodiments of the present invention can be any product or component having a display function such as a liquid crystal display panel, an electronic paper, an OLED (Organic Light Emitting Diode) panel, a cell phone, a tablet computer, a TV set, a display, a laptop computer, a digital photo frame or a navigator, etc.

An array substrate is provided in at least one embodiment of the present invention and the array substrate comprises a plurality of signal boards. In the plurality of signal boards, at least one pair of mutually connected signal boards employs a plug-in connection mode. A first plug-in structure is provided on a first signal board of each pair of signal boards connected in a plug-in connection mode, and a second plug-in structure corresponding to or matching the first plug-in structure is provided on a second signal board of the pair of signal boards connected in the plug-in connection mode.

For example, a first plug-in structure includes at least one pin and a second plug-in structure includes at least one plughole that corresponds to the at least one pin; or a first plug-in structure includes a USB plug and a second plug-in structure includes a USB interface that corresponds to the USB plug; or a first plug-in structure includes at least one hanging hook and a second plug-in structure includes at least one hanging loop that corresponds to the at least one hanging hook; or a first plug-in structure includes a clamping strip and a second plug-in structure includes a clamping groove that corresponds to the clamping strip.

For example, a first plug-in structure is disposed on a lateral side of a first signal board, and a second plug-in structure is disposed on a lateral side of the second signal board that faces the first plug-in structure and is at a same horizontal plane as a surface where the first plug-in structure locates; or a first plug-in structure and a second plug-in structure are respectively disposed on a surface of the first signal board and a surface of the second signal board that overlap with each other.

For example, a plug-in connection mode is employed in each pair of mutually connected signal boards in an array substrate.

For example, a first signal board is a TCON (timing controller) board and a second signal board is a system board for supplying a driving signal; or a first signal board is a system board for supplying a driving signal and a second signal board is a power supply board for supplying a working voltage; or a first signal board is a TCON board and a second signal board is a power supply board for supplying a working voltage; or an array substrate comprises at least two system boards for supplying driving signals, with the first signal board being one system board of the two system boards and the second signal board being the other system board of the two system boards.

In an array substrate provided in the embodiments of the present invention, the respective signal boards can be disposed by referencing to previous embodiments related to the display device and similar description will not be described here again.

A display device and an array substrate are provided in the embodiments of the present invention. The display device comprises a display panel and signal boards which supply signals to the display panel. A plug-in connection mode is employed in at least a pair of signal boards. A first plug-in structure is provided on a first signal board of each pair of signal boards connected in a plug-in connection mode, and a second plug-in structure corresponding to the first plug-in structure is provided on a second signal board of the pair of signal boards connected in the plug-in connection mode. Because a plug-in connection mode is employed in at least one pair of signal boards that are mutually connected, the quantity of signal lines arranged between signal boards can be reduced, which makes assembly and disassembly more convenient.

It has to be pointed out that, unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," "the," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "left," "right" and the like are only used to indicate relative position relationship, and when the position of the object which is described is changed, the relative position relationship may be changed accordingly.

What are described above is related to the illustrative embodiments of the disclosure only and not limitative to the scope of the disclosure. The scopes of the disclosure are defined by the accompanying claims.

This application claims the benefit of Chinese patent application No. 201520003243.0 filed on Jan. 4, 2015, which is incorporated by reference herein in its entirety as part of this application.

The invention claimed is:

1. A display device, comprising:

a display panel; and signal boards, which supply signals to the display panel; wherein at least a pair of signal boards that are connected with each other is electrically connected using a plug-in connection mode, wherein:

a first plug-in structure is provided on a first signal board of each pair of signal boards connected in the plug-in connection mode;

a second plug-in structure corresponding to the first plug-in structure is provided on a second signal board of the pair of signal boards connected in the plug-in connection mode; and the first plug-in structure and the second plug-in structure are respectively disposed on a surface of the first signal board and a surface of the second signal board that overlap with each other, and after the first plug-in structure and the second plug-in structure are plugged together with each other, the first signal board and the second signal board are partially overlapped with each other.

2. The display device according to claim 1, wherein the first plug-in structure includes a pin and the second plug-in structure includes a plughole that corresponds to the pin.

3. The display device according to claim 1, wherein the first plug-in structure includes a universal serial bus plug and the second plug-in structure includes a universal serial bus interface that corresponds to the universal serial bus plug.

4. The display device according to claim 1, wherein the first plug-in structure includes a hanging hook and the second plug-in structure includes a hanging loop that corresponds to the hanging hook.

5. The display device according to claim 1, wherein the first plug-in structure includes a clamping strip and the second plug-in structure includes a clamping groove that corresponds to the clamping strip.

6. The display device according to claim 1, wherein each pair of signal boards in the display device that are connected with each other is electrically connected using the plug-in connection mode.

7. The display device according to claim 1, wherein the first signal board is a timing controller board and the second signal board is a system board for supplying a driving signal; or, the first signal board is a system board for supplying a driving signal and the second signal board is a power supply board for supplying a working voltage; or, the first signal board is a timing controller board and the second signal board is a power supply board for supplying a working voltage.

8. The display device according to claim 1, wherein the display device comprises at least two system boards for supplying driving signals, with the first signal board being one system board of the at least two system boards and the second signal board being another system board of the at least two system boards.

9. An array substrate, comprising a plurality of signal boards, wherein:

at least a pair of signal boards that are connected with each other is electrically connected using a plug-in connection mode;

a first plug-in structure is provided on a first signal board of each pair of signal boards connected in the plug-in connection mode;

a second plug-in structure corresponding to the first plug-in structure is provided on a second signal board of the pair of signal boards connected in the plug-in connection mode; and the first plug-in structure and the second plug-in structure are respectively disposed on a surface of the first signal board and a surface of the second signal board that overlap with each other, and after the first plug-in structure and the second plug-in structure are plugged together with each other, the first signal board and the second signal board are partially overlapped with each other.

10. The array substrate according to claim 9, wherein the first plug-in structure includes a pin and the second plug-in structure includes a plughole that corresponds to the pin; or the first plug-in structure includes a universal serial bus plug and the second plug-in structure includes a universal serial bus interface that corresponds to the universal serial bus plug; or the first plug-in structure includes a hanging hook and the second plug-in structure includes a hanging loop that corresponds to the hanging hook; or the first plug-in structure includes a clamping strip and the second plug-in structure includes a clamping groove that corresponds to the clamping strip.

11. The array substrate according to claim 9, wherein each pair of signal boards in the display device that are connected with each other is electrically connected using the plug-in connection mode.

12. The array substrate according to claim 9, wherein the first signal board is a timing controller board and the second signal board is a system board for supplying a driving signal; or, the first signal board is a system board for supplying a driving signal and the second signal board is a power supply board for supplying a working voltage; or, the first signal board is a timing controller board and the second signal board is a power supply board for supplying a working voltage; or, the array substrate comprises at least two system boards for supplying driving signals, with the first signal board being one system board of the at least two system boards and the second signal board being another system board of the at least two system boards.

13. The display device according to claim 2, wherein the first plug-in structure is disposed on a lateral side of the first signal board, and the second plug-in structure is disposed on a lateral side of the second signal board that faces the first plug-in structure and is at a same horizontal plane as a surface where the first plug-in structure locates.

14. The display device according to claim 2, wherein the first plug-in structure and the second plug-in structure are respectively disposed on a surface of the first signal board and a surface of the second signal board that overlap with each other.

15. The display device according to claim 1, wherein each pair of signal boards in the display device that are connected with each other is electrically connected using the plug-in connection mode.

16. The display device according to claim 2, wherein the first signal board is a timing controller board and the second signal board is a system board for supplying a driving signal; or, the first signal board is a system board for supplying a driving signal and the second signal board is a power supply board for supplying a working voltage; or, the first signal board is a timing controller board and the second signal board is a power supply board for supplying a working voltage.

17. The display device according to claim 2, wherein the display device comprises at least two system boards for supplying driving signals, with the first signal board being one system board of the at least two system boards and the second signal board being another system board of the at least two system boards.

* * * * *